US007341471B2

(12) United States Patent
Yamakami

(10) Patent No.: US 7,341,471 B2
(45) Date of Patent: Mar. 11, 2008

(54) TRANSCEIVER MODULE

(75) Inventor: Tohru Yamakami, Shinagawa (JP)

(73) Assignee: Fujitsu Component Limited, Tokyo (JP)

( * ) Notice: Subject to any disclaimer, the term of this patent is extended or adjusted under 35 U.S.C. 154(b) by 0 days.

(21) Appl. No.: 11/546,907

(22) Filed: Oct. 13, 2006

(65) Prior Publication Data

US 2007/0232146 A1 Oct. 4, 2007

(30) Foreign Application Priority Data

Mar. 29, 2006 (JP) ..... 2006-091603

(51) Int. Cl.
*H01R 13/627* (2006.01)

(52) U.S. Cl. ..... 439/352

(58) Field of Classification Search ..... 439/357, 439/352, 609, 385, 361
See application file for complete search history.

(56) References Cited

U.S. PATENT DOCUMENTS 4,872,736 A * 10/1989 Myers et al. ..... 385/60
6,824,416 B2 * 11/2004 Di Mascio ..... 439/352
6,908,323 B2 * 6/2005 Ice ..... 439/160
7,212,410 B2 * 5/2007 Larson ..... 361/726

FOREIGN PATENT DOCUMENTS

JP 3032117 2/2000
JP 2005-316484 11/2005

* cited by examiner

*Primary Examiner*—Phuong Dinh
(74) *Attorney, Agent, or Firm*—Staas & Halsey LLP

(57) ABSTRACT

A disclosed transceiver module includes: a body portion; a connector for external connection disposed at an end of the body portion, where a cable connector is connected thereto while the transceiver module is attached; and a pull sleeve disposed so as to surround the connector for external connection, where when the pull sleeve is pulled, a latch is released and the transceiver module is pulled out from an attached status while the cable connector is detached, wherein the pull sleeve includes a pinch portion for configured to be pinched by fingers within a thickness range thereof.

6 Claims, 8 Drawing Sheets

TRANSCEIVER MODULE

BACKGROUND OF THE INVENTION

1. Field of the Invention

The present invention generally relates to a transceiver module and more particularly to a transceiver module provided with a function for transmitting and receiving data, the transceiver module being configured to be used upon being installed on an information processing apparatus such as a server or the like.

2. Description of the Related Art

Ethernet (registered trademark) LAN is a bus LAN (Local Area Network). The Ethernet LAN is constructed by disposing a server apparatus with a function for transmitting and receiving data and connecting a signal transmission path to the server. A size of a system such as the LAN varies depending on users where the system may be as long as dozens of kilometers if a length of data transmission is long or may be as short as ten meters or so if the length is short. In view of this, in order to flexibly meet the needs of users, plural types of transceiver modules provided with a function for transmitting and receiving data are prepared in accordance with communication distance and the like. The server apparatus has several attachment portions for the transceiver modules and is constructed by attaching a desired transceiver module to the attachment portion. Further, when the length of data transmission is changed, for example, the transceiver module is detached from the attachment portion and other transceiver module is attached thereto in order to support the change of length.

FIG. 1 is a schematic diagram showing a status of a transceiver module 10 when being attached to a server apparatus 1 and being pulled out from the server apparatus 1 in a Y2 direction.

As shown in FIG. 1-(*e*), the transceiver module 10 includes a body portion 11, a connector 12 for external connection in a Y2 side, a pull sleeve 13 surrounding the connector 12, and a latch mechanism (elements except a latch claw 14 are not shown in the drawings). When the pull sleeve 13 is pulled in the Y2 direction, the latch mechanism is operated and the latch claw 14 is recessed. Further, the transceiver module 10 has a thin structure and a thickness (height) A of the pull sleeve 13 is the same as a thickness (height) B of the body portion 11.

In FIG. 1-(*a*), numeral 2 designate a panel of the server apparatus 1, numeral 3 designates an opening, numeral 4 designates a printed board, and numeral 5 designates a connector.

As shown in FIG. 1-(*a*), the transceiver module 10 is attached to the server apparatus 1, in which the transceiver module 10 is inserted into the opening 3 of the panel 2 in the server apparatus 1 and connected to the connector 5, the latch claw 14 locks a portion of a rear surface of the panel 2 facing the opening 3, and the connector 12 and the pull sleeve 13 protrude toward the outside of the server apparatus 1.

As shown in FIG. 1-(*b*), a cable connector 101 at an end of a cable 100 extending from other device is connected to the connector 12. In accordance with this, the above-mentioned device is connected to the server apparatus 1. This is an operation status of the system.

When the system is changed, first, as shown in FIG. 1-(*c*), the cable connector 101 is pulled out and detached from the connector 12. Next, as shown FIG. 1-(*d*), an operator holds the pull sleeve 13 using the fingers and pulls in the Y2 direction. As a result of this operation, the latch mechanism is activated and the latch claw 14 is recessed and the transceiver module 10 is pulled out from the server apparatus 1 as shown in FIG. 1-(*e*). Thereafter, other transceiver module is inserted into the opening 3 of the panel 2 and attached.

Patent Document 1: Japanese Patent No. 3032117

Patent Document 2: Japanese Laid-Open Patent Application No. 2005-316484

In the pull sleeve 13, upper and lower surfaces as portions held by the fingers are flat, so that pinch of the fingers may not be sufficient and thus poses a problem in that the pull-out procedure is difficult to perform when the fingers hold the pull sleeve 13 and pull in the Y2 direction.

In this case, in order to improve the pinch of the fingers, one solution may be to form protrusions upward and downward on the Y2 side of the pull sleeve 13. However, the thickness A of the pull sleeve 13 must be the same as the thickness B of the body portion 11 in accordance with the standard, so that it is difficult to form the above-mentioned protrusions.

SUMMARY OF THE INVENTION

It is a general object of the present invention to provide an improved and useful transceiver module in which the above-mentioned problems are eliminated.

A more specific object of the present invention is to provide a transceiver module superior in operability when the transceiver module is pulled out from a device.

In order to achieve the afore-mentioned objects, the present invention provides a transceiver module including: a body portion; a connector for external connection disposed at an end of the body portion, where a cable connector is connected thereto while the transceiver module is attached; and a pull sleeve disposed so as to surround the connector for external connection, where when the pull sleeve is pulled, a latch is released and the transceiver module is pulled out from an attached status while the cable connector is detached, wherein the pull sleeve includes a pinch portion configured to be pinched by fingers within a thickness range thereof.

According to the present invention it is possible to form a pinch portion without increasing a size of a thickness of the pull sleeve. Thus, it is possible to improve operability for a procedure for pulling out a transceiver module from an apparatus, the transceiver module having a thin structure where a size of a thickness of the pull sleeve is limited.

Other objects, features and advantage of the present invention will become more apparent from the following detailed description when read in conjunction with the accompanying drawings.

DETAILED DESCRIPTION OF THE PREFERRED EMBODIMENTS

In the following, embodiments of the present invention will be described with reference to the accompanying drawings.

EXAMPLE 1

[Outline of Server Apparatus and Transceiver Module]

Figure 1:
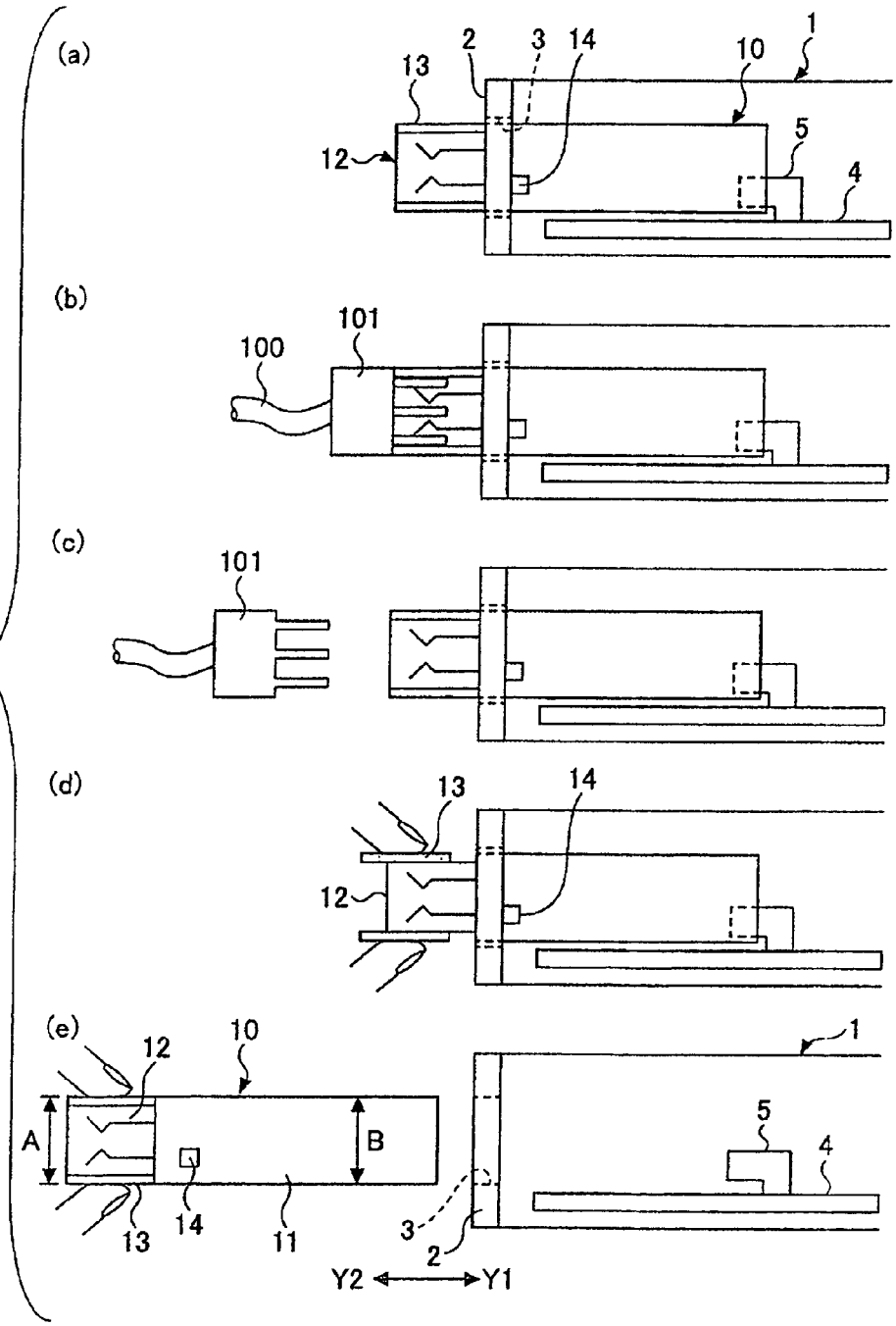
FIG.1 PRIOR ART
FIG. 1 is a schematic diagram showing a procedure for pulling out a transceiver module from a server apparatus.
Figure 2:
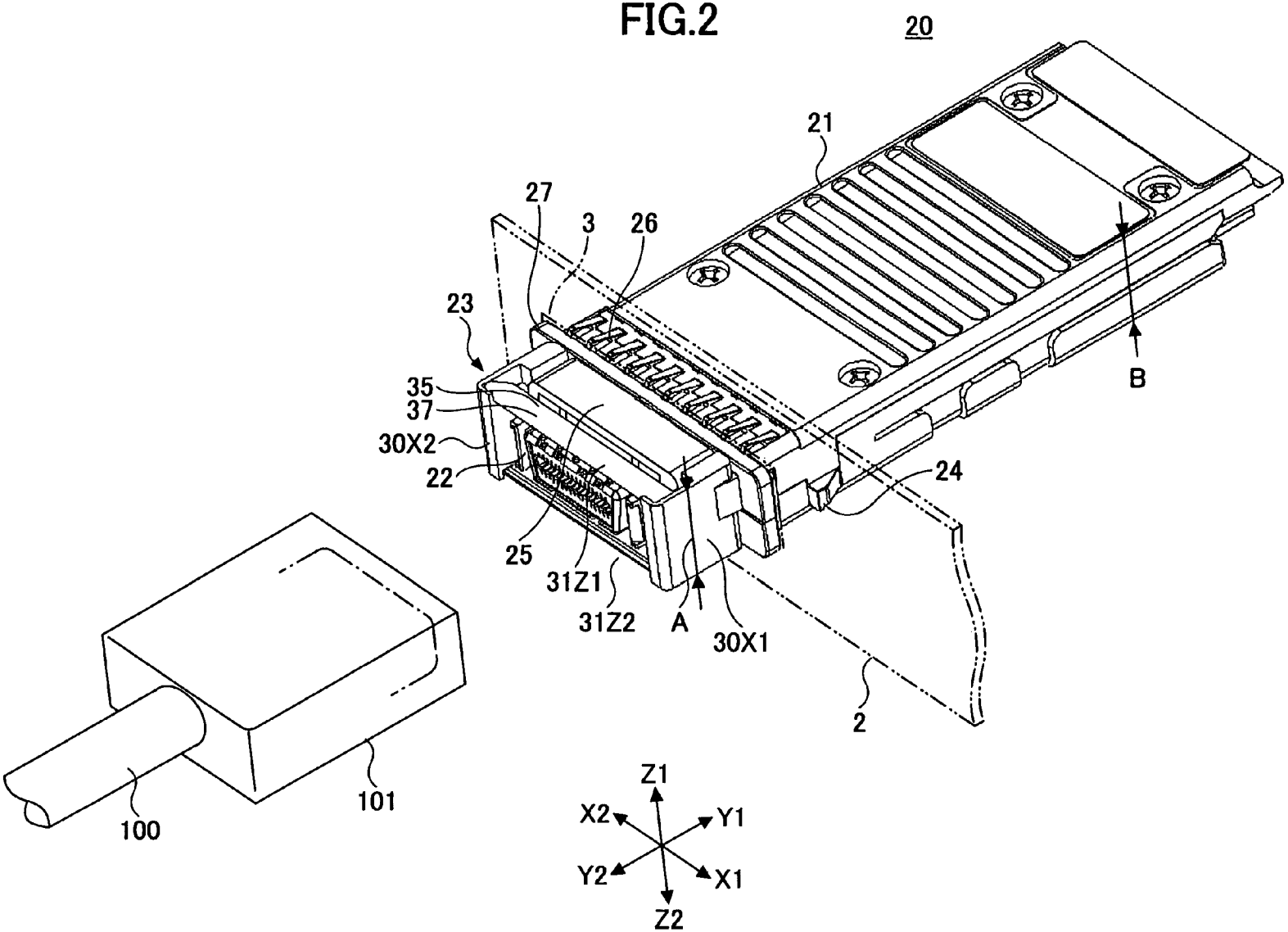
FIG. 2 is a diagram showing a thin transceiver module according to example 1 of the present invention.

FIG. 2 is a diagram showing a thin transceiver module 20 according to example 1 of the present invention.

A double headed arrow X1-X2 indicates a width direction of the transceiver module 20 (width direction of the server apparatus 1), a double headed arrow Y1-Y2 indicates a longitudinal direction of the transceiver module 20 (depth direction of the server apparatus 1), and a double headed arrow Z1-Z2 indicates a height (thickness) direction of the transceiver module 20 (height direction of the server apparatus 1). The Y2 side is the front and a Y1 side is a tip of an insertion direction.

The transceiver module 20 includes a body portion 21, a connector 22 for external connection on the Y2 side, a quadrangular surrounding portion 25 surrounding a base side of the connector 22, a pull sleeve 23 surrounding the connector 22 for external connection, and a latch mechanism (elements except a latch claw 24 are not shown in the drawings). When the pull sleeve 23 is pulled in the Y2 direction, the latch mechanism is operated and the latch claw 24 is recessed. A gasket portion 26 and a flange portion 27 are disposed at an end of the body portion 21 on the Y2 side.

The body portion 21 includes a data transmitter/receiver and the like embedded in a metal housing having a cuboid shape.

The surrounding portion 25 protrudes on the Y2 side from the flange portion 27. The connector 22 protrudes on the Y2 side from the flange portion 27, in which the connector 22 protrudes on the Y2 sides through and relative to the surrounding portion 25.

Further, the transceiver module 20 has a thin structure and a thickness A of the pull sleeve 23 is the same as a thickness B of the body portion 21.

The transceiver module 20 is attached to the server apparatus 1, in which the transceiver module 20 is inserted into the opening 3 of the panel 2 in the server apparatus 1, the flange portion 27 is brought into abutment with a front surface of the panel 2, and the latch claw 24 locks a portion of a rear surface of the panel 2 facing the opening 3. Further, the gasket portion 26 is brought into contact with the opening 3 of the panel 2 and the connector 22 and the pull sleeve 23 protrude toward the outside of the server apparatus 1.

[Structure of Pull Sleeve 23]

Figure 3:
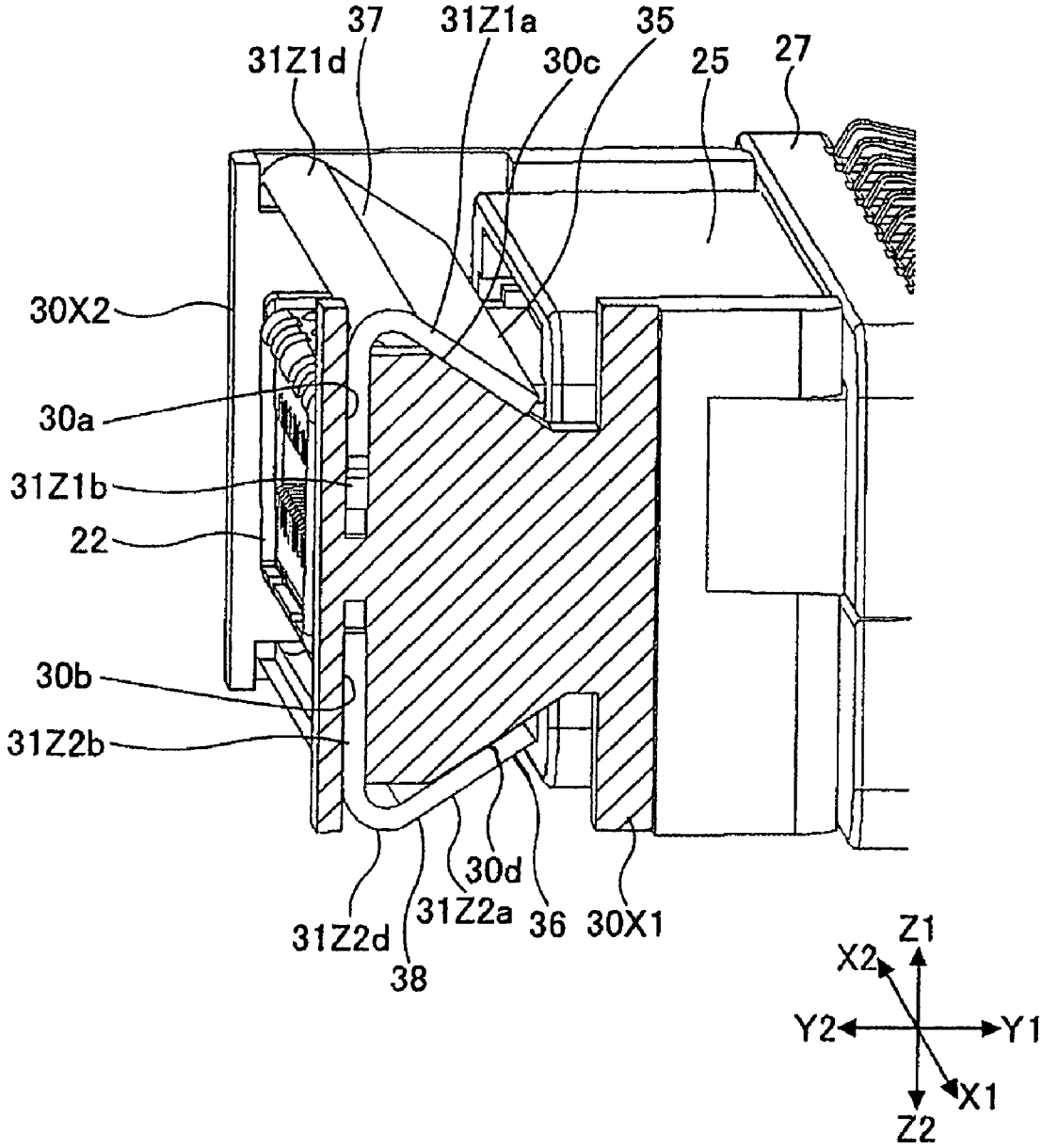
FIG. 3 is a partially enlarged cross-sectional view of a connector for external connection and a pull sleeve of FIG. 2.
Figure 4:
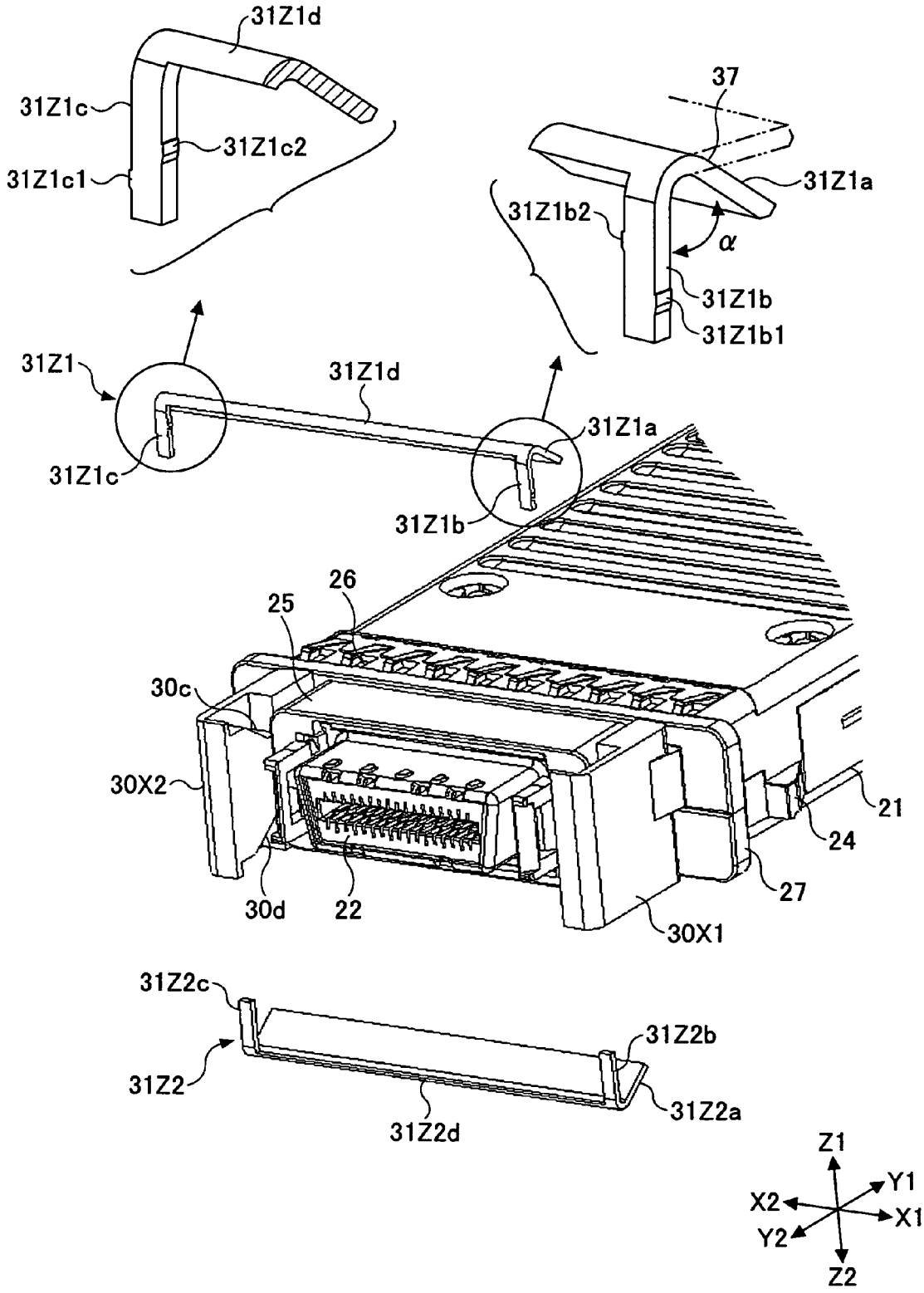
FIG. 4 is an exploded perspective view showing a portion of a pull sleeve.

FIG. 3 is a partially enlarged cross-sectional view of the connector 22 for external connection and the pull sleeve 23. FIG. 4 is an exploded perspective view showing a portion of the pull sleeve 23. As shown in FIGS. 3 and 4, the pull sleeve 23 includes side plate members 30X1 and 30X2 on both sides and laterally placed members 31Z1 and 31Z2 for connecting between the side plate members 30X1 and 30X2 on both sides, the laterally placed members 31Z1 and 31Z2 being positioned on a Z1 side and a Z2 side and made of a metallic plate. The pull sleeve 23 has a square frame shape.

The side plate members 30X1 and 30X2 are positioned on right and left side faces of the surrounding portion 25, a portion thereof is in the inside of the body portion 21, and the side plate members 30X1 and 30X2 are capable of sliding in the Y2 direction. The side plate members 30X1 and 30X2 have a symmetric form, and an inside face thereof has openings 30*a* and 30*b* and inclined surfaces 30*c* and 30*d* as receiving portions.

The openings 30*a* and 30*b* are positioned on the Y2 side. The opening 30*a* is formed in a Z2 direction from the Z1 side and the opening 30*b* is formed in a Z1 direction from the Z2 side. The inclined surfaces 30*c* and 30*d* are formed from positions of the openings 30*a* and 30*b* and arranged such that the inside face is narrowed in a Y1 direction.

The laterally placed member 31Z1 includes a long rectangular plate portion 31Z1*a* and leg portions 31Z1*b* and 31Z1*c* at both ends of the plate portion 31Z1*a*. On the Y2 side, the plate portion 31Z1*a* has a reinforced curvature portion 31Z1*d* which is a portion of a cylinder. The leg portions 31Z1*b* and 31Z1*c* extend from ends of the curvature portion 31Z1*d*. The leg portions 31Z1*b* and 31Z1*c* and the plate portion 31Z1*a* form an acute angle $\alpha$ (about 60 degrees) of less than 90 degrees. The plate portion 31Z1*a* is capable of displacement in a direction such that the aforementioned angle $\alpha$ becomes 90 degrees by elastically bending bases of the leg portions 31Z1*b* and 31Z1*c*. The leg portions 31Z1*b* and 31Z1*c* include bulge portions 31Z1*b*1, 31Z1*b*2, 31Z1*c*1, and 31Z1*c*2.

The laterally placed member 31Z2 has a form symmetric to the laterally placed member 31Z1. The laterally placed member 31Z2 includes a plate portion 31Z2*a*, a curvature portion 31Z2*d*, and leg portions 31Z2*b* and 31Z2*c*.

In the laterally placed member 31Z1, the leg portions 31Z1*b* and 31Z1*c* are pressed into the openings 30*a* and fixed. The laterally placed member 31*z*1 is laterally placed between the side plate members 30X1 and 30X2 on the Z1 side, and the side plate members 30X1 and 30X2 are connected. In the laterally placed member 31Z2, the leg portions 31Z2*b* and 31Z2*c* are pressed into the openings 30*b* and fixed. The laterally placed member 31Z2 is laterally placed between the side plate members 30X1 and 30X2 on the Z2 side, and the side plate members 30X1 and 30X2 are connected.

As shown in FIG. 3, the plate portion 31Z1*a* substantially extends along the inclined surface 30*c* and is recessed in the Z2 direction relative to an upper surface of the pull sleeve 23. A concave portion 35 is formed on the upper surface of the pull sleeve 23. The plate portion 31Z2*a* substantially extends along the inclined surface 30*d* and is recessed in the Z1 direction relative to a lower surface of the pull sleeve 23. A concave portion 36 is formed on the lower surface of the pull sleeve 23. A tip portion b of the cable connector 101 is inserted into a portion where tips of the plate portions 31Z1*a* and 31Z2*a* exist when the cable connector 101 is connected. Further, the plate portions 31Z1*a* and 31Z2*a* on the Y2 side are capable of movement, so that the plate portions 31Z1*a* and 31Z2*a* are capable of deformation in the upper or lower direction.

The inclined surfaces 30*c* and 30*d* function as stoppers for the plate portions 31Z1*a* and 31Z2*a*. In other words, when the plate portions 31Z1*a* and 31Z2*a* are held using the fingers, both ends of the plate portion 31Z1*a* are brought into abutment with the inclined surfaces 30*c* and both ends of the plate portion 31Z2*a* are brought into abutment with the inclined surfaces 30*d*. In other words, the inclined surfaces 30*c* and 30*d* receive both ends of the plate portions 31Z1*a* and 31Z2*a*, so that the plate portions 31Z1*a* and 31Z2*a* are prevented from unnecessarily deforming in a direction for further tapering.

[Relationship Between Cable Connector 101 and Pull Sleeve 23]

Figure 5:
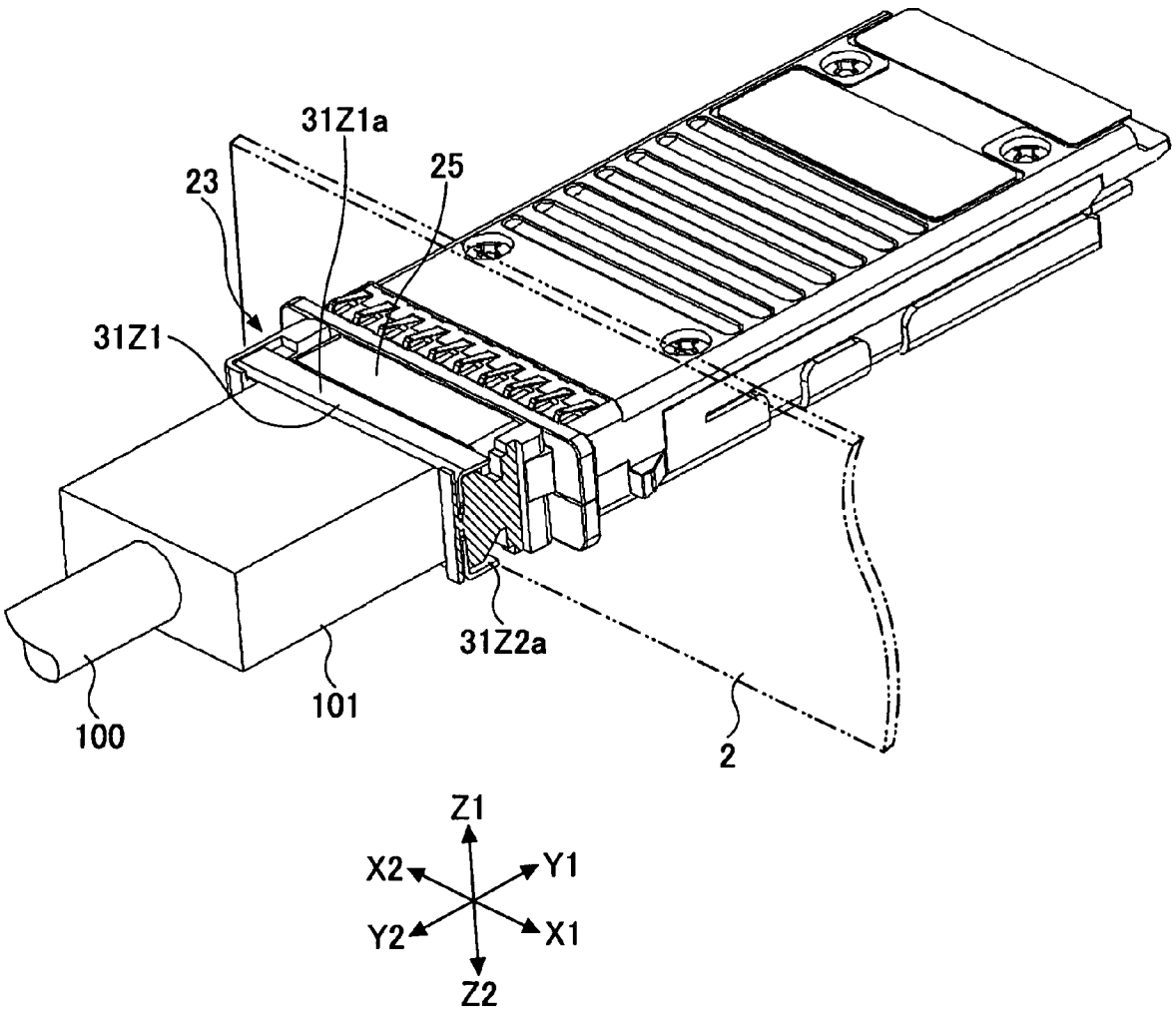
FIG. 5 is a diagram showing a transceiver module in use.
Figure 6:
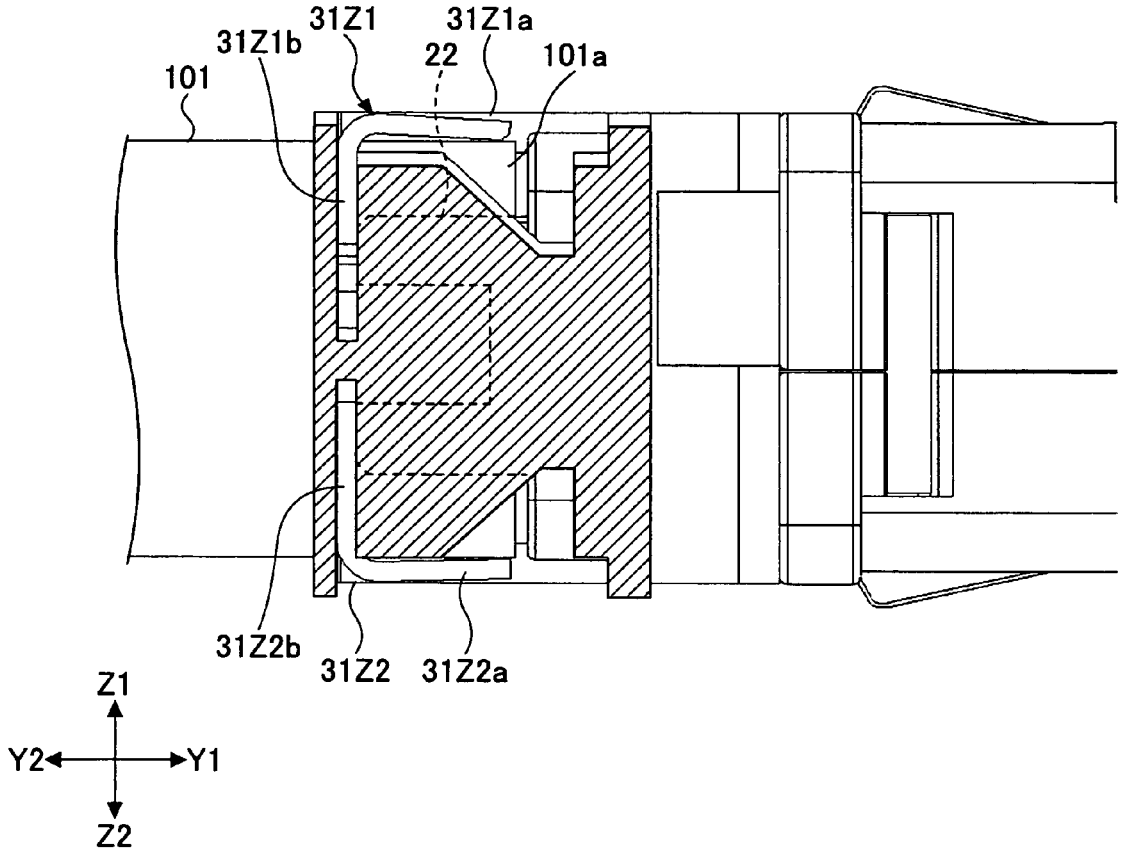
FIG. 6 is an enlarged view of a portion where a cable connector is connected to a connector for external connection in FIG. 5.

FIG. 5 is a diagram showing the transceiver module 20 in use, namely, the cable connector 101 at an end of the cable 100 extending from other device and the connector 22 for external connection being connected to each other. FIG. 6 is an enlarged view of a portion where the cable connector 101 is connected to the connector 22 for external connection.

A tip portion 101*a* of the cable connector 101 is fitted in the pull sleeve 23 and connected to the connector 22.

When a tip portion 101*a* of the cable connector 101 is fitted in the pull sleeve 23 and reaches an end position, the tip portion 101*a* of the cable connector 101 is brought into abutment with the plate portions 31Z1*a* and 31Z2*a* and further pushes the plate portions 31Z1*a* and 31Z2*a*. In this step, the plate portion 31Z1*a* is pushed up and displaced in a direction such that the angle α becomes 90 degrees with the elastic bending of the bases of the leg portions 31Z1*b* and 31Z1*c*. And the plate portion 31Z1*a* is brought into contact with an upper surface of the tip portion 101*a* of the cable connector 101 and kept in a substantially level status. The plate portion 31Z2*a* is pressed down and displaced in a direction such that the angle α becomes 90 degrees with the elastic bending of the bases of the leg portions 31Z2*b* and 31Z2*c*. And the plate portion 31Z2*a* is brought into contact with a lower surface of the tip portion 101*a* of the cable connector 101 and kept in a substantially level status.

In other words, although the plate portions 31Z1*a* and 31Z2*a* are inclined in a tapered manner such that the connection of the cable connector 101 is blocked, when the plate portions 31Z1*a* and 31Z2*a* are stretched in the upper and lower direction, the cable connector 101 is fitted in the pull sleeve 23 to a predetermined position and connected to the connector 22 in a normal manner.

Other device is connected to the server apparatus 1 and the system is operated while the cable connector 101 is connected to the connector 22. In this operation status of the system, the laterally placed members 31Z1 and 31Z2 are brought into contact with the cable connector 101, cover the upper surface and the lower surface of the tip portion 101*a* of the cable connector 101, and function as shields.

[Pull-out Procedure of Transceiver Module 20 and Operation]

A procedure for pulling out the transceiver module 20 for system change and the like is performed by holding the pull sleeve 23 on the upper and lower sides thereof using the fingers and firmly pulling out while the cable connector 101 is detached.

When the cable connector 101 is detached, the plate portions 31Z1*a* and 31Z2*a* are inclined in a tapered manner due to the elastic force of the bases of each leg portion 31Z1*b* and the like. As shown in FIG. 3, the pull sleeve 23 is recessed and the concave portions 35 and 36 are formed. As a result of the formation of the concave portions 35 and 36, pinch portions 37 and 38 are formed on portions on the Y2 side relative to the concave portions 35 and 36 (namely, the opposite side of the body portion 21). The pinch portions 37 and 38 are formed without increasing the thickness A.

Figure 7:
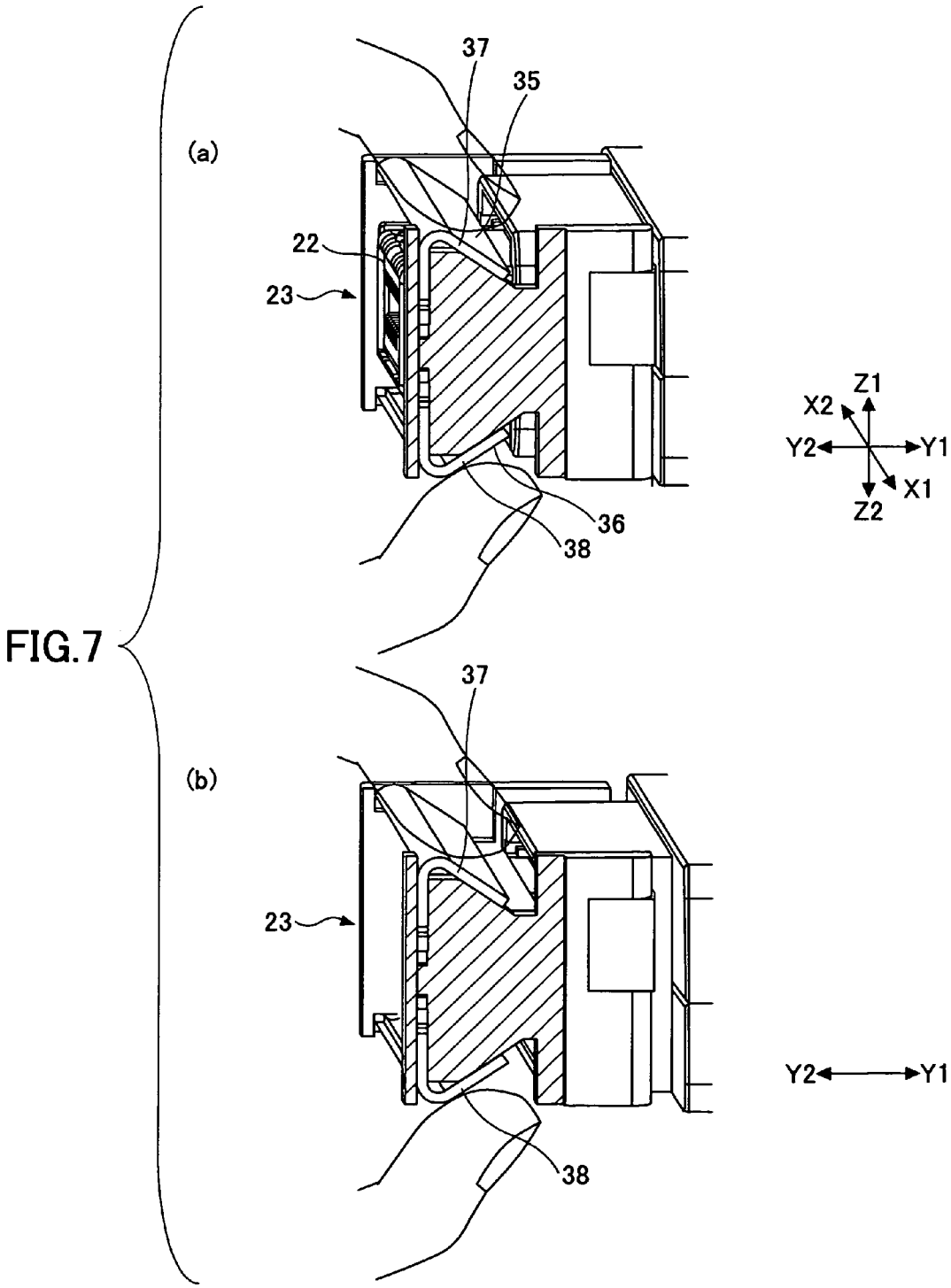
FIG. 7 is a diagram showing a pull-out procedure of a transceiver module.

When the pull sleeve 23 is held on the upper and lower sides using the fingers, the fingers are placed on the concave portions 35 and 36 and pinch the pinch portions 37 and 38 when pulling the fingers in the Y2 direction as shown in FIG. 7-(*a*). Thus, when pulling the fingers in the Y2 direction so as to pull the pull sleeve 23, the fingers are not slipped and it is easy to pull the pull sleeve 23. When the pull sleeve 23 is moved in the Y2 direction as shown in FIG. 7-(*b*), the latch claw 24 is recessed and the latch is released, so that the transceiver module 20 is pulled out. Thus, it is possible to stably perform the procedure for pulling out the transceiver module 20.

Further, when pulling the pull sleeve 23, the pull sleeve 23 is firmly pinched using the fingers. In accordance with this, although the plate portions 31Z1*a* and 31Z2*a* are affected by bending force, both ends of the plate portions 31Z1*a* and 31Z2*a* are fixed and middle portions between the fixed portions are the curvature portions 31Z1*d* and 31Z2*d*, the plate portions 31Z1*a* and 31Z2*a* are not bent, and it is stably possible to hold and pull the pull sleeve 23.

In addition, the laterally placed members 31Z1 and 31Z2 may be made of synthetic resin.

EXAMPLE 2

Figure 8:
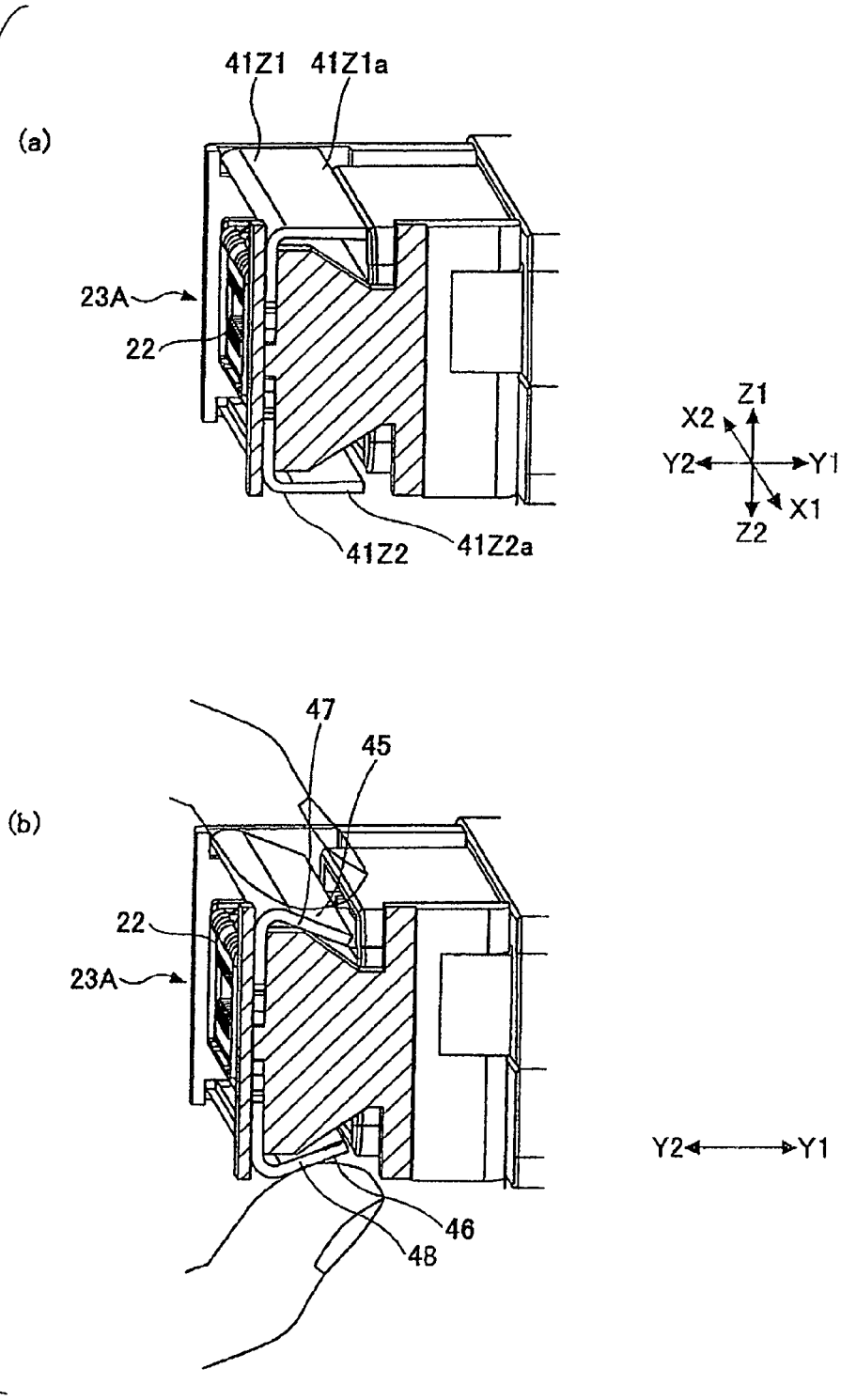
FIG. 8 is a diagram showing a pull sleeve of a thin transceiver module according to example 2 of the present invention.

FIG. 8-(*a*) shows a pull sleeve 23A of a transceiver module according to example 2 of the present invention.

As shown in FIG. 8-(*a*), while a cable connector is detached, laterally placed members 41Z1 and 41Z2 are L-shaped when viewed from an X1 side and plate portions 41Z1*a* and 41Z2*a* are kept in a level status. And ends on a body portion side (the Y1 side) are capable of movement, so that the plate portions 41Z1*a* and 41Z2*a* are capable of elastic deformation in a tapered direction.

When the pull sleeve 23A is held on upper and lower sides, the plate portions 41Z1*a* and 41Z2*a* are elastically deformed and concave portions 45 and 46 are formed as shown in FIG. 8-(*b*). As a result, pinch portions 47 and 48 are formed without increasing a thickness of the pull sleeve 23A. When pulling the fingers in the Y2 direction, the fingers pinch the pinch portions 47 and 48, so that it is stably possible to hold and pull the pull sleeve 23A.

The present invention is not limited to the specifically disclosed embodiment, and variations and modifications may be made without departing from the scope of the present invention.

The present application is based on Japanese priority application No. 2006-091603 filed Mar. 29, 2006, the entire contents of which are hereby incorporated herein by reference.

What is claimed is:

1. A transceiver module, comprising:

a body portion;

a connector for external connection disposed at an end of the body portion, where a cable connector is connectable thereto while the transceiver module is attached; and a pull sleeve disposed so as to surround the connector for external connection, where when the pull sleeve is pulled, a latch is released and the transceiver module is pulled out from an attached status while the cable connector is detached, wherein the pull sleeve includes a pinch portion configured to be pinched by fingers, the pinch portion being disposed within a thickness height of the body portion.

2. The transceiver module according to claim 1, wherein:

the pull sleeve includes:

right and left side plate members; and upper and lower laterally placed members positioned at an upper surface and a lower surface, the upper and lower laterally placed members connecting the right and left side plate members and being laterally placed between the right and left side plate members, wherein:

the upper and lower laterally placed members have a concave portion configured to be level by being pushed outwardly by the cable connector when the cable connector is connected: and the pinch portion comprises an upper pinch portion and a lower pinch portion, wherein the upper and lower pinch portions are opposite to the respective concave portions relative to the body portion.

3. The transceiver module according to claim 2, wherein:

the upper and lower laterally placed members include a long rectangular plate portion and leg portions at both ends of the plate portion, the plate portion and the leg portions forming an acute opening angle, the leg portions at both ends are pressed into the side plate members and fixed and the plate portion of the upper laterally placed member and the plate portion of the lower laterally placed member extend in a direction of the body portion in an inclined manner such that an area formed with the upper and lower laterally placed members is tapered, and the plate portion of the upper laterally placed member and the plate portion of the lower laterally placed member form the respective concave portions and the upper and lower pinch portions.

4. The transceiver module according to claim 2, wherein the upper and lower laterally placed members include a long rectangular plate portion and leg portions at both ends of the plate portion, the plate portion and the leg portions forming an acute opening angle, the leg portions at both ends are pressed into the side plate members and fixed and the plate portion of the upper laterally placed member and the plate portion of the lower laterally placed member extend in a direction of the body portion in an inclined manner such that an area formed with the upper and lower laterally placed members is tapered, the plate portion of the upper laterally placed member and the plate portion of the lower laterally placed member form the respective concave portions and the upper and lower pinch portions, and the right and left side plate members have receiving portions in order to prevent the plate portion of the upper laterally placed member and the plate portion of the lower laterally placed member from unnecessarily deforming in a direction for further tapering.

5. A transceiver module comprising:

a body portion;

a connector for external connection disposed at an end of the body portion, where a cable connector is connectable thereto while the transceiver module is attached; and a pull sleeve disposed so as to surround the connector for external connection, where when the pull sleeve is pulled, a latch is released and the transceiver module is pulled out from an attached status while the cable connector is detached, wherein the pull sleeve forms a pinch portion configured to be pinched by fingers upon pinching using the fingers, the pinch portion is disposed within a thickness height of the body portion.

6. The transceiver module according to claim 5, wherein the pull sleeve includes:

right and left side plate members; and upper and lower laterally placed members positioned at an upper surface and a lower surface, the upper and lower laterally placed members connecting the right and left side plate members and being laterally placed between the right and left side plate members, wherein the upper and lower laterally placed members are configured to be level and capable of elastic deformation in a direction for tapering defined by the right and left side plate members on a body portion side while the cable connector is detached.

* * * * *